United States Patent [19]

McDougall

[11] 4,449,735

[45] May 22, 1984

[54] SKIING APPARATUS

[76] Inventor: David A. McDougall, C. P. 5, Ste-Agathe. Quebec, Canada

[21] Appl. No.: 297,313

[22] Filed: Aug. 28, 1981

[51] Int. Cl.[3] ..... A63C 5/00

[52] U.S. Cl. ..... 280/818

[58] Field of Search ..... 280/11.15, 11.18, 818, 280/601, 607, 609

[56] References Cited

U.S. PATENT DOCUMENTS

| | | | |
|---|---|---|---|
| 1,499,448 | 7/1924 | Crawford | 280/11.15 |
| 2,905,479 | 9/1959 | Schomers | 280/21 A X |
| 3,921,994 | 11/1975 | Locati | 280/21 A X |
| 4,175,759 | 11/1979 | Strunk | 280/21 A X |

FOREIGN PATENT DOCUMENTS

| | | | |
|---|---|---|---|
| 2806883 | 8/1979 | Fed. Rep. of Germany | 280/818 |

*Primary Examiner*—Joseph F. Peters, Jr.
*Assistant Examiner*—Michael Mar

[57] ABSTRACT

A skiing device having at least a pair of parallel, elongated, longitudinally extending runners is provided with a platform therebetween, and quadrilateral linkage arrangements extend between the runners and the platform independently while at least one link member extends between the runners. The quadrilateral linkage arrangements between the runners and the platform allow the ski to carve a turn in the slope of a hill with more ease since the two runners present separate control edges.

1 Claim, 20 Drawing Figures

SKIING APPARATUS

BACKGROUND OF THE INVENTION

1. Field of the Invention

The present invention relates to skis, and more particularly, to an improvement in alpine skis.

2. Description of the Prior Art

It is well known that when a skier is maneuvering a turn on a downhill slope or is tracking, that is, crossing a slope obliquely, he must rely almost entirely on the control edges of the skis. These edges must be kept sharp in order to prevent uncontrolled slipping. In order to use the control edges, the skier must tilt the skis about their longitudinal axes and must maintain this unnatural attitude, thus creating considerable stress on his ankles.

It has been contemplated that skis should be constructed such that they are split or segmented longitudinally such that each ski would present more than one control edge to the surface of the snow, whereby the weight of the skier would be more evenly distributed on the ski when the skier is tracking or is carving a turn. Attempts to provide a longitudinal segmented ski are illustrated by U.S. Pat. No. 3,549,162, Coutts, 1970. In the Coutts patent, a ski is split from the tail to a point intermediate of the ski and is provided with a control device for ensuring the parallelism of the segments and for preventing the segments from flexing away from each other beyond predetermined limits. However, it is thought that a fully segmented ski would be much better in this regard since the plurality of control edges would extend the full length of the ski. Such a ski is described in U.S. Pat. No. 3,921,994, Locati, 1975. In the Locati patent, slide or hydraulic devices maintain two segments of a ski in two separate parallel planes. Accordingly, the Locati patent provides two control edges for each ski through a limited range of angles.

SUMMARY OF THE INVENTION

It is an aim of the present invention to provide an improved segmented ski of the type illustrated in the Locati patent.

It is a further aim of the present invention to provide a longitudinal segmented ski which will provide a greater carving or tracking control with less effort on the part of the skier and less stress on the skier's ankles.

A construction in accordance with the present invention comprises a ski apparatus having at least two longitudinal co-extension runners, each runner having control edges, a platform provided between the runners and extending parallel thereto, at least a quadrilateral linkage arrangement between each runner and said platform, each quadrilateral linkage arrangement including a plurality of link members pivotally connected to the runners and the platform such that their respective pivoting axes extend longitudinally of the ski and parallel thereto such that any tilting movement applied to the platform will result in translatory movement of the runners in relative intersecting arcs whereby there is always at least two control edges adapted to contact the skiing surface.

In a specific embodiment of the present invention, there is provided a pair of skis to be worn by an alpine skier, with each ski comprising a pair of runners and a platform, all of which extend longitudinally and are parallel to each other. The runners are each provided with mounting brackets and quadrilateral linkage arrangements extend between the mounting brackets and the platform, the platform being suitable for mounting a ski boot binding, at least one link member pivotally connected to both runners, the axes of the pivoting connections between the various link members and the runners and platform all being parallel and extending longitudinally of the ski such that when a skier applies a tilting motion to the platform through the ski boot and binding, the runners will follow a translatory movement relative to the platform such that two ski control edges provided on the runners will always be adapted to be in contact with the skiing surface.

In another embodiment of the present invention, a sailing device is provided, including a main platform on which a sailing mast is provided, a skiing segment being provided on either side of the sailing platform, and a quadrilateral linkage arrangement is provided between each ski segment and the platform such that a translatory movement of the skis will result when the sailing device tilts in the direction of turning.

The translation movement of the ski segments in response to the tilting of the platform, in two intersecting arcs, is especially effective in the embodiment utilized by downhill skiers. As the platform is tilted from 0° to 45°, the line of force of the skier's leg shifts gradually from a position at the center of the two runners when the ski is flat to a position just over the inside edge of the downhill runner, as the downhill runner follows a translatory arc relative to the platform to a position under the platform. The improved carving and stability of such skis result from the gradual progressive shift of the line of force over the downhill runner of each ski rather than from an increased weight on the runner edges or increased number of edges provided by the skis.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
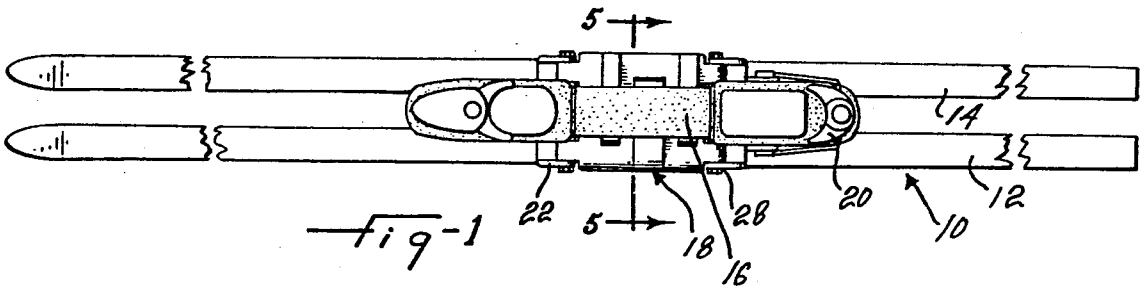
FIG. 1 is a top plan view showing an alpine ski in accordance with the present invention.
Figure 2:
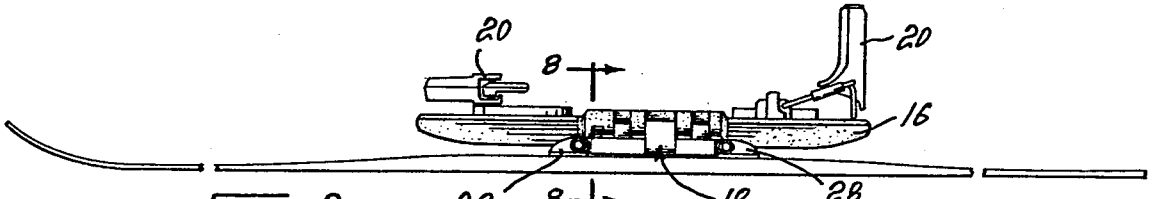
FIG. 2 is a side elevation of the ski shown in FIG. 1.

Reference will now be made to the drawings and particularly FIGS. 1 through 4. The embodiment shown in these Figures includes a ski 10 which would be used by a downhill skier. Each ski 10 would have a pair of longitudinal co-extensive segments or runners 12 and 14 connected to a platform 16 by means of a linkage 18. The platform 16 is provided with a conventional downhill ski binding 20. Of course, there would be provided a ski 10 for each foot of the skier such that the skier would be skiing on four ski runners.

A bracket 22 is mounted forwardly on the ski runner 12 while a linkage mounting member 26 is pivotally connected to the bracket 22 by means of a bolt 24. A bracket 28 is mounted aft of the linkage mounting member 26 on the runner 12 and includes a bolt 30 for pivotally mounting the other end of the linkage mounting member 26. Similarly, on the runner 14, there is provided a bracket 56, a bracket 62, a mounting member 60 pivotally mounted to the brackets 56 and 62 by means of bolts 58 and 64. The bolts 24 and 58 pass through lost-motion slots provided in the mounting members 26 and 60 respectively to allow for flexing of the portion of runners 12 and 14 between the respective brackets 22, 28 and 56, 62.

A link member 32 is pivotally connected to the mounting member 60 by means of a pivot pin 66, and in turn is connected to the platform by means of a pivot pin 42 subtending the platform slot 40. The link member 32 is pivotally connected at its other end to the mounting member 26 by means of pivot pin 34. A central link member 36, which is laterally offset from link member 32, is provided and is hinged to mounting member 60 by means of pivot pin 68. It is further connected to the platform 16 by means of pivot pin 46 traversing the platform slot 44. The link member 36 is connected to the mounting member 26 by means of pivot pin 38. A further link member 48, which is identical to the link member 32, is connected to the mounting member 60 by means of pivot pin 70 and passes through a platform wall 52 of the platform 16 and is connected thereto by means of pivot pin 54. The other end of the link member 48 is pivotally connected to the mounting member 26 by means of a pivot pin 50.

Figure 7:
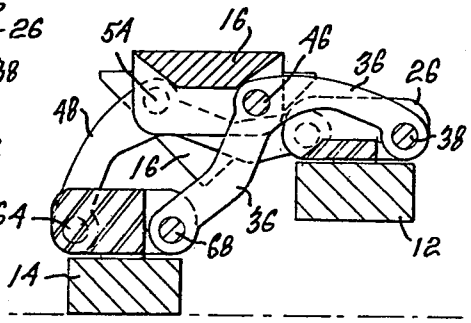
FIG. 7 is a cross-sectional view, similar to FIG. 5, but showing the elements in yet another different operative position.
Figure 6:
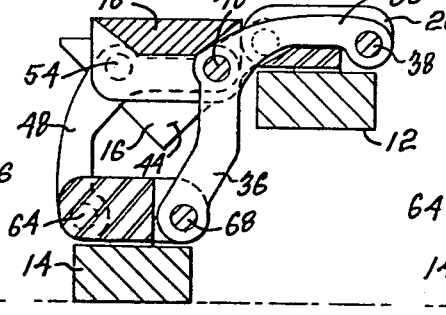
FIG. 6 is a cross-sectional view, similar to FIG. 5, but showing the elements in a different operative position.
Figure 5:
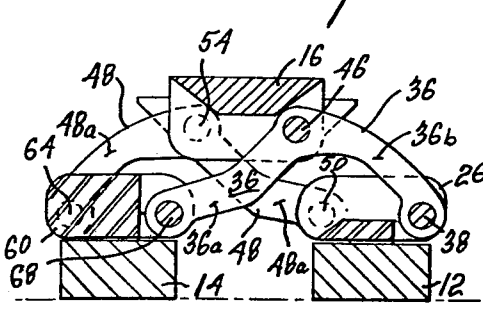
FIG. 5 is a cross-sectional view taken along line 5—5 of FIG. 1.
Figure 3:
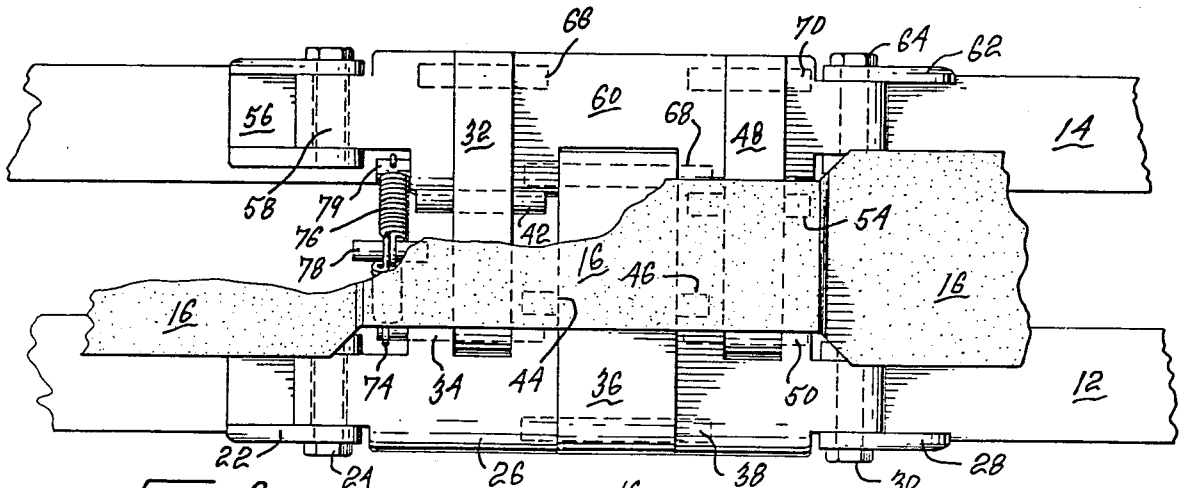
FIG. 3 is a fragmentary top plan view of the ski shown in FIG. 1.
Figure 4:
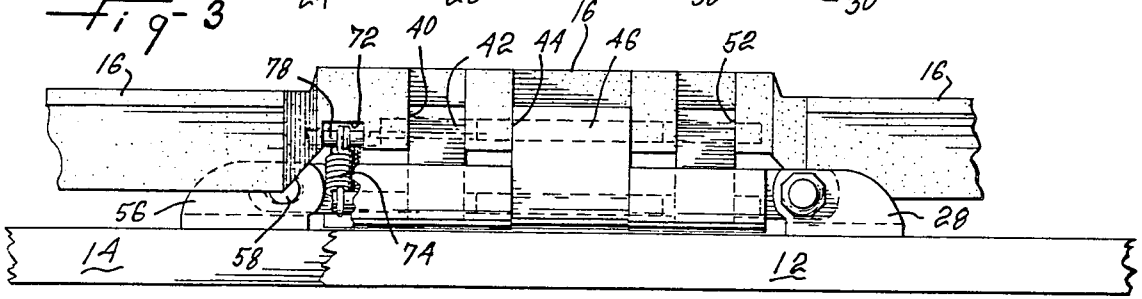
FIG. 4 is a fragmentary side elevation of details of the ski shown in FIG. 2.

FIGS. 5 through 7 illustrate the quadrilateral arrangement of the link members as seen in a lateral plane. Link member 48 is shown in these Figures although link member 32 is not. However, in the lateral plane, link member 32 is coincident with link member 48. As can be seen from FIGS. 5 through 7, arms 48*a* and 36*a* of respective links 48 and 36 form a quadrilateral linkage between the mounting member 60 on the runner 14 and the platform 16. Likewise, the legs 36*b* and 48*b* form, in the lateral plane, a quadrilateral linkage between the platform 16 and the mounting member 26 on the runner 12. Furthermore, since each of the linkages 32, 36 and 48 are unitary bellcranks, a direct linkage is provided between the mounting member 60 on the runner 14 and the mounting member 26 on the runner 12. As can be seen from FIGS. 6 and 7, if the skier's leg is tilted at an acute angle to the slope, the downhill runner 14 will follow an arc inwardly relative to the platform 16, while the runner 12 will follow a similar translatory arc upwardly and outwardly relative to the platform 16. Each of the runners presents control edges to the surface of the slope.

Figures 8, 9, 10, 11, 12:
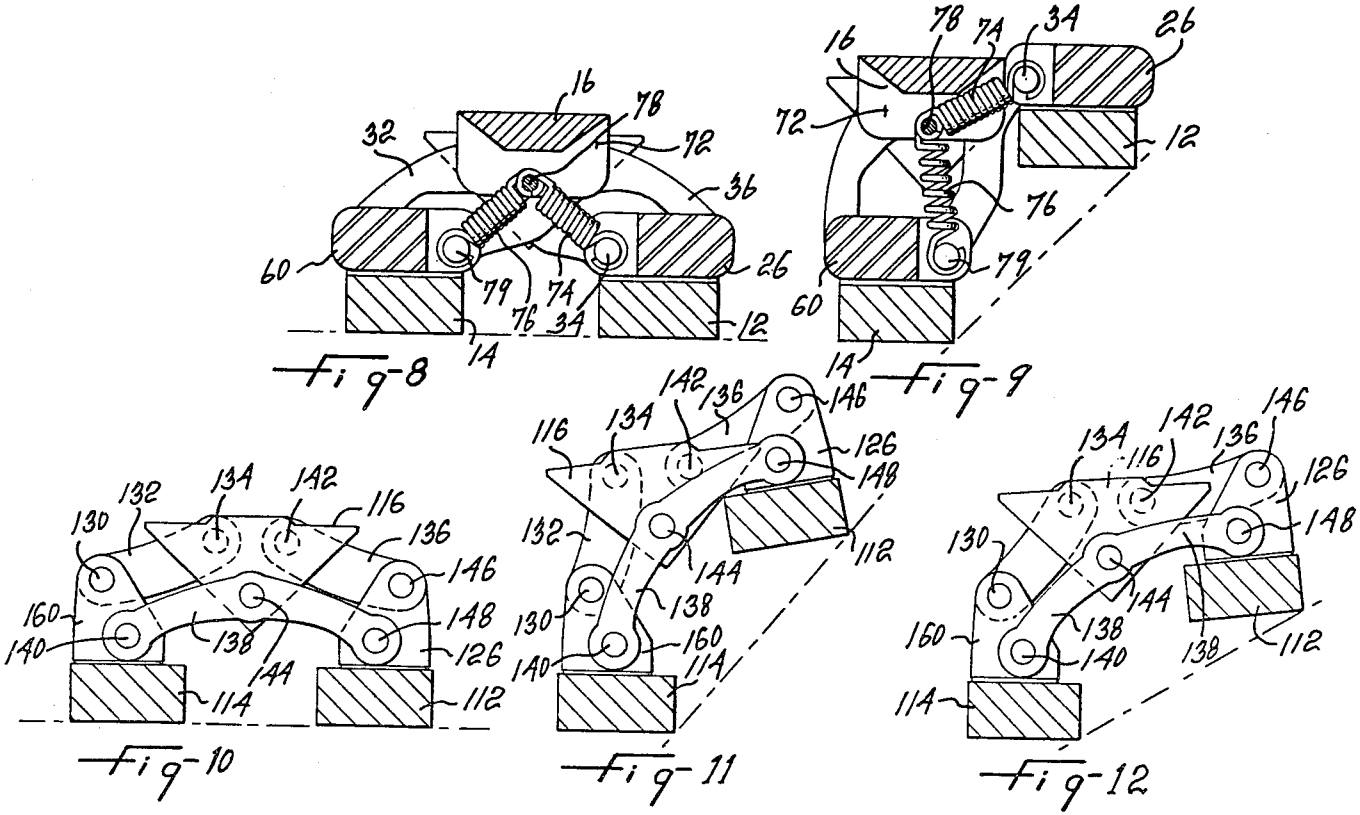
FIG. 8 is a vertical cross-sectional view taken along line 8—8 of FIG. 2.
FIG. 9 is a cross-sectional view, similar to FIG. 8, but showing the elements in a different operative position similar to FIG. 6.
FIG. 10 is a vertical cross-section, similar to FIG. 5, but of another embodiment of the present invention.
FIG. 11 is a vertical cross-sectional view, similar to FIG. 10, but showing the embodiment of FIG. 10 in a different operative position.
FIG. 12 is a vertical cross-sectional view, similar to FIG. 10, showing the embodiment of FIG. 10 in a different operational position.

FIGS. 8 and 9 further illustrate the spring arrangement of the ski 10 shown in FIGS. 1 through 7. Forward of the platform 16, there is provided a pair of springs 74 and 76 connected to a central member 78 on the platform 16 and to respective pins 34 and 79 in the mounting members 26 and 60 of the runners 12 and 14 respectively. The neutral position of the springs is as shown in FIG. 8 when the runners are flat. However, as the platform 16 is tilted and the runners follow their translatory arcs, the spring 76, as shown with respect to runner 14, is extended such that the tension therein tends to draw the runners back to their flat position. It is important that such resilient tension is applied to the ski runners 12 and 14 so as to prevent unnecessary loose flapping of the runners as the ski runs over a slope.

FIGS. 10 through 12 illustrate a similar ski as shown in FIGS. 1 to 9, but with a different quadrilateral linkage arrangement. As noted in these drawings, the quadrilateral linkages between the runners and the platform is not quite a parallelogram arrangement such that the bottom plane of the runners 112 and 114 do not follow a translatory movement relative to each other although the axes of the runners follow a translatory path.

As shown in FIGS. 10 through 12, the runners are identified by the numerals 112 and 114, while the platform is identified by the numeral 116. A mounting member 126 is mounted to runner 112 in a manner similar to that shown in FIGS. 1 through 9. Similarly, a mounting member 160 is provided on the runner 114 while link 138 extends from the mounting member 160 to the mounting member 126 and is connected thereto by pivot pins 140 and 148 respectively. The link member 138 is also pivotally connected to the platform 116 through the pivot pin 144. Separate link members 132 and 136 are also provided with link 132 pivotally connected to the mounting member 160 by means of pivot pin 130 at one end and to the platform 116 by means of a pivot pin 134. Similarly, link member 136 is pivotally connected to the mounting member 126 by means of a pivot pin 146 at one end and to the platform 116 by the pivot pin 142 at the other end.

Tilting of the platform 116 results in the downhill runner 114 in this case to be at a steeper angle to the plane of the slope of the hill than the runner 112. This provides for improved carving in short radius turns.

Figure 13:
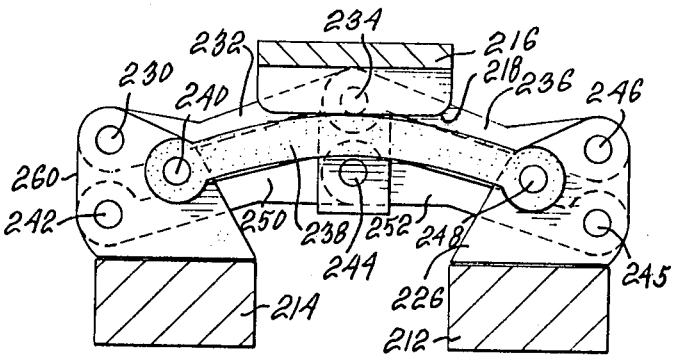
FIG. 13 is a vertical cross-section of a ski similar to FIG. 5 but showing yet another embodiment of the present invention.
Figure 14:
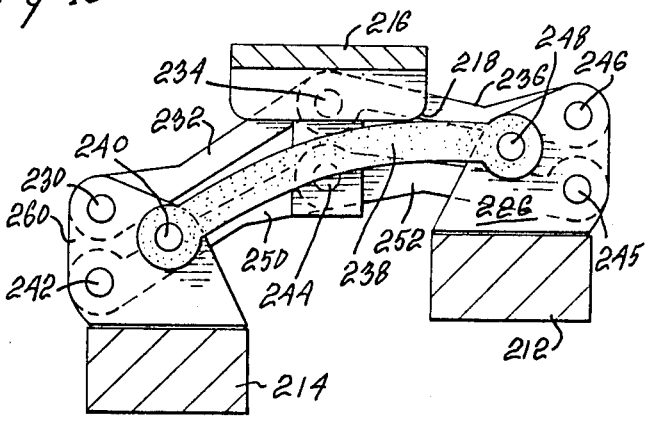
FIG. 14 is a vertical cross-section, similar to FIG. 13, but showing the elements of the embodiment of FIG. 13 in a different operative position.
Figure 15:
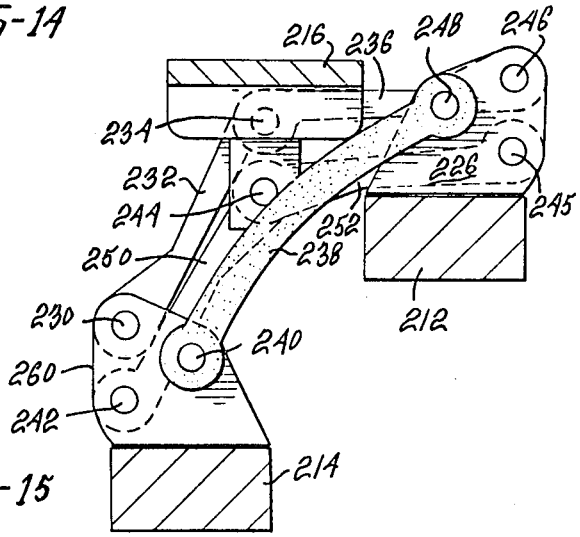
FIG. 15 is a vertical cross-section, similar to FIG. 13, and showing the various elements of the embodiment in FIG. 13 in a different operative position.

FIGS. 13 through 15 are also illustrative of a downhill ski but with a different quadrilateral linkage. The embodiment shown in FIGS. 13 to 15 is similar to the ski of FIGS. 1 through 9 but includes a different quadrilateral linkage arrangement which allows for a lower profile of the ski. The ski is made up of runners 212 and 214 and includes mounting members 226 and 260 which are provided on the runners 212 and 214 similar to the arrangement shown in FIGS. 1 to 4. Link members 236 and 252 are connected to the mounting member 226 by means of pivot pins 246 and 245 respectively, while at their free ends, they are pivotally connected to the platform 216 by means of pivot pins 234 and 244 respectively. Similarly, link members 232 and 250 are pivotally connected to the mounting member 260 by means of pivot pins 230 and 242, while the free ends are connected to the pivot pins 234 and 244 respectively on the platform 216. A further curved link member 238 extends between the runners and is connected to the mounting member 260 by means of pivot pin 240 and to the mounting member 226 by means of the pivot pin 248. The platform 216 has a fulcrum surface 218 which bears on the curved link member 238. Accordingly, as the platform is tilted, the platform is directly weighed on the curved link member 238 at different locations as shown in FIGS. 14 and 15. Accordingly, the fulcrum is actually shifted through the contact point of the surface 218 and the curved link 238 such that in the case of the tilting as shown in FIGS. 14 and 15 whereby the runner 212 is the uphill runner, the fulcrum will have shifted to weigh on the uphill runner more than on the downhill runner which again provides improved stability of the ski in the tilted position.

Figure 16:
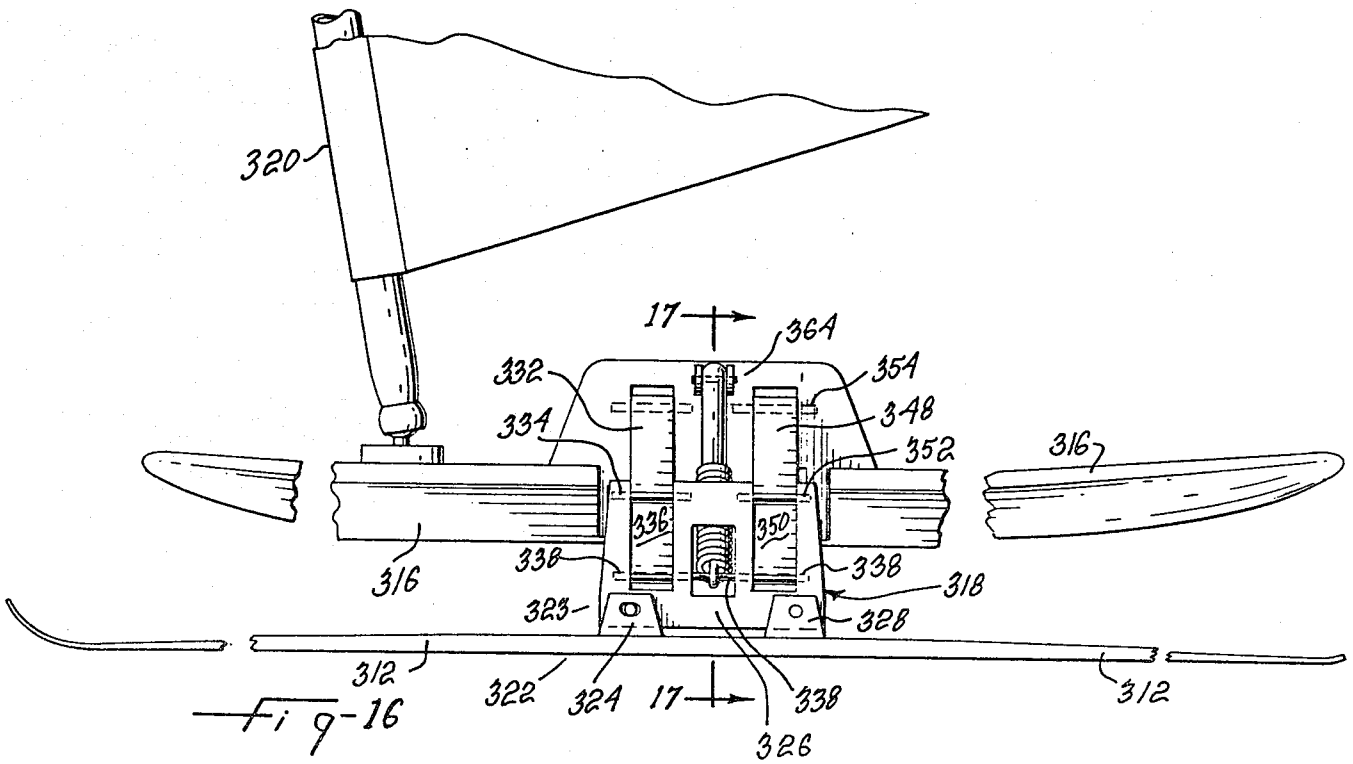
FIG. 16 is a fragmentary side elevation of another embodiment of the present invention showing a sailing device.
Figure 17:
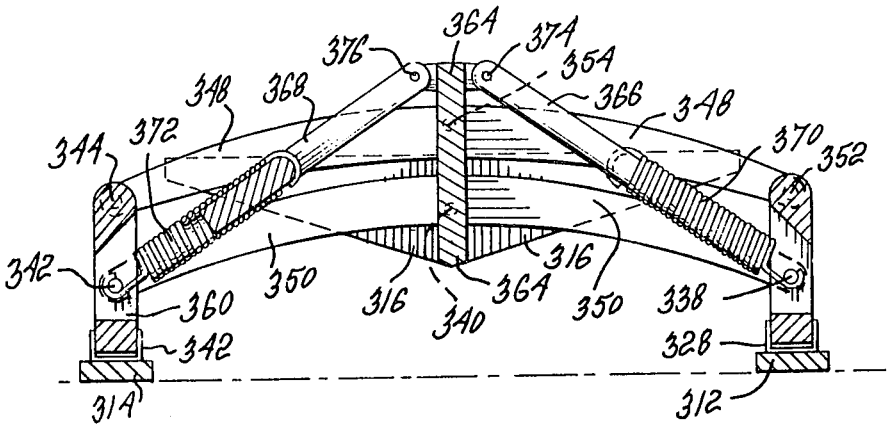
FIG. 17 is a vertical cross-section taken through line 17—17 of FIG. 16.
Figure 18:
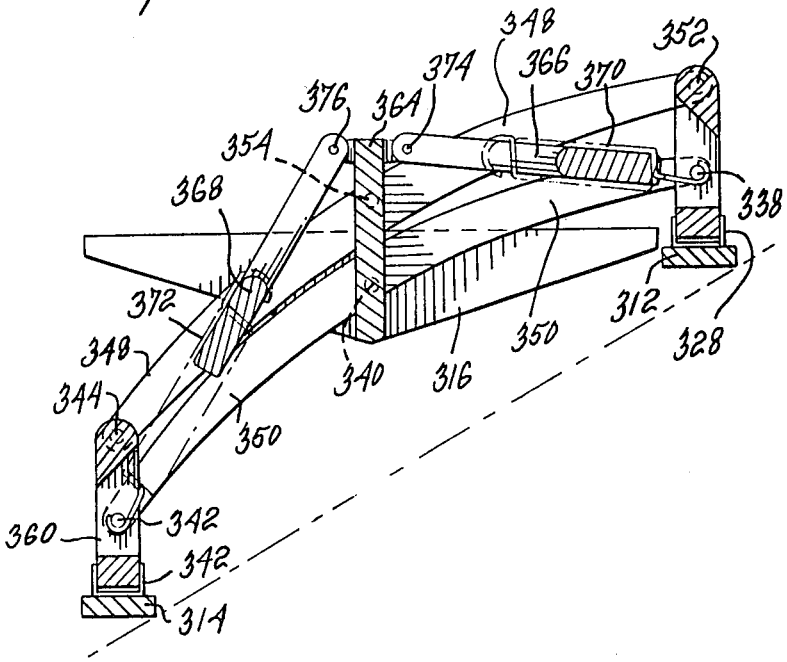
FIG. 18 is a vertical cross-section, similar to FIG. 17, but showing the elements in a different operative position.

The embodiment shown in FIGS. 16 through 18 represents a sailing device which would be used on a snow covered surface. The platform in this case, identified as 316, is much wider than the platform shown in FIGS. 1 to 4 and would be approximately the size of a sail board such as is known under the trade mark "WINDSURFER". A "windsurfer" type sail would be provided on the mast 320 which in turn is universally connected to the forward position of the platform 316.

A separate runner 312 and 314 is located on either side of the platform 316 and includes brackets 324 and 328 on the ski runner 312, for instance. The brackets 324 and 328 mount a mounting member 326 to which two pairs of link members are provided forming the quadrilateral linkage 318. On the platform 316, a link support member 364 is provided, while a support member 360 is located on the ski runner 314, and the rear bracket 342 mounting the mounting member 360 is shown in FIGS. 17 and 18.

Link members 332 and 336 are identical to the link members 348 and 350. Only link members 348 and 350 will be described herein for purposes of brevity.

As shown in FIGS. 17 and 18, two link members 348 and 350 extend between the support member 360 and the support member 326. Link member 348 is pivotally connected to the support member 360 by means of pivot pin 344 and is connected centrally to the support member 364 on the platform 316 by means of the pivot pin 354. The other end of the link member 348 is pivotally connected to the support member 326 by means of the pivot pin 352. Similarly, a link member 350 is pivotally connected to the support member 326 by means of the pivot pin 338, and at the other end it is connected to the support member 360 by means of the pivot pin 342. At the center of the link member 350 there is a pivot pin 340 connecting the link member 350 to the support member 364 of the platform 316. Accordingly, the link members 348 and 350 provide quadrilateral linkages on either side of the platform to the respective runners 312 and 314 at the same time the unitary link is provided between the runners 312 and 314. Furthermore, spring members 372 and 370 mounted on rods 368 and 366 respectively extend between the pivot pins 342, 376, 338 and 374 respectively. The springs 372 and 370 act to return the platform and the ski runner to a level position as shown in FIG. 17.

The mast and sail 320 will provide the necessary motive force to advance the sail device over a snow surface, while turning will be effected by applying torque to the platform 316, thereby tilting the platform and causing the runners 312 and 314 to tilt as shown in FIG. 18, for instance, to provide a controlled short or long radius turn.

Figure 19:
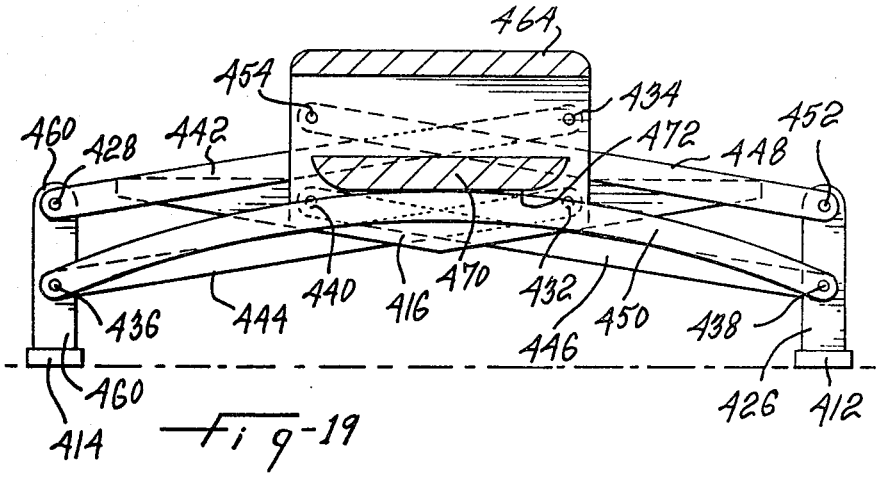
FIG. 19 is a vertical cross-section of a sailing device, similar to FIG. 17, but showing a different embodiment of the linkage thereof.
Figure 20:
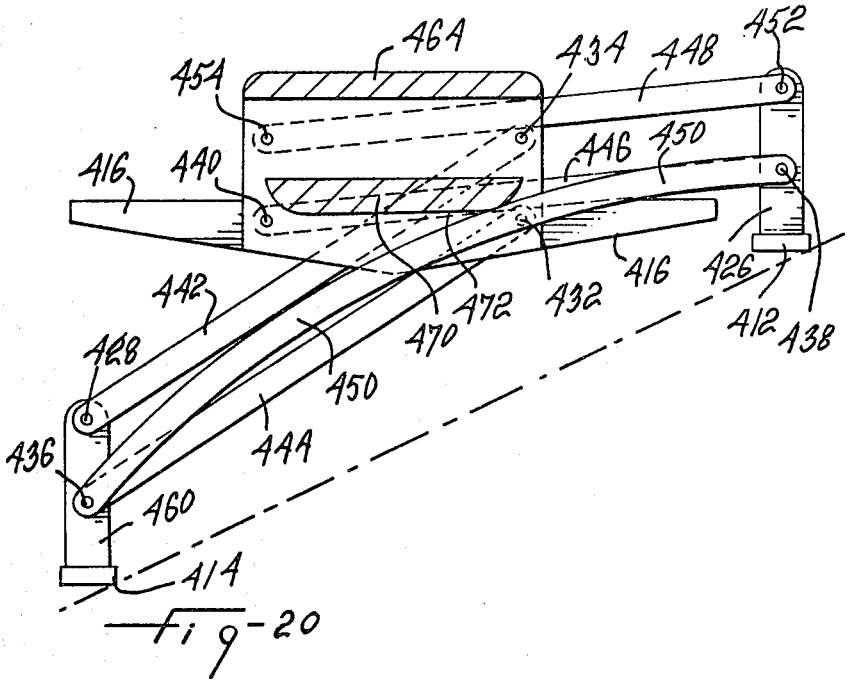
FIG. 20 is a vertical cross-section, similar to FIG. 19, and showing the elements of the embodiment shown in FIG. 19 in a different operative position.

Another embodiment of a linkage system for the sail device shown in FIG. 16 is illustrated in FIGS. 19 and 20. Essentially, the embodiment shown in FIGS. 19 and 20 is a variation of the linkage illustrated in FIGS. 13 to 15. In this embodiment, there is provided runners 412 and 414 and a platform 416. The platform 416 has an upstanding linkage support member 464. Quadrilateral linkages include the link members 448 and 446 pivotally connected to the support member 426 on the runner 412 by means of pivot pins 452 and 438 respectively, and their free ends are connected to the support member 464 at pivot pins 454 and 440 respectively. Similarly, on the other side of the device, links 442 and 444 extend from the mounting member 460 to the member 464 and are connected to the mounting member 460 by means of pivot pins 428 and 436 respectively. The free ends of link members 442 and 444 are connected to the member 464 by means of pivot pins 434 and 432 respectively. A further curved link member 450 extends between the mounting member 460 and the mounting member 426 and is pivotally connected to pivot pins 436 and 438 respectively.

Finally, a platform member 470 having a fulcrum surface 472 is provided which bears on the curved link 450. As in the embodiment of FIGS. 13 through 15, as the platform 416 is tilted, the fulcrum will shift through the contact point between the fulcrum surface 472 and the curved link 450.

I claim:

1. A skiing apparatus comprising at least two longitudinal co-extensive runners, each runner having control edges, a platform provided between the runners and extending parallel thereto, at least a quadrilateral linkage arrangement between each runner and said platform, each quadrilateral linkage arrangement including a plurality of link members pivotally connected to the runners with their respective pivoting axes extending longitudinally of the ski apparatus and parallel thereto such that any tilting movement applied to the platform will result in translatory movement of the runners in relative intersecting arcs whereby there is always at least two control edges adapted to contact the skiing surface, wherein the linkage arrangements include at least a pair of parallel link member extending between the outer extremity of one runner and the platform and forming a parallelogram therewith, a further pair of link members extending between the other runner and the platform and pivotally connected at the outer extremity of the runner and at the platform forming a parallelogram therewith, and a further link member extending between the runner and being curved in an arc facing away from the runners and the platform including a support surface adapted to bear on the arc-shaped link member such that as the linkage arrangement is tilted, the fulcrum point of the platform is shifted towards the uphill runner.

* * * * *